United States Patent [19]

Smith-Johannsen et al.

[11] 3,947,257

[45] Mar. 30, 1976

[54] BENZOTRIFLUORIDE FUEL ADDITIVE FOR INTERNAL COMBUSTION ENGINES

[75] Inventors: Robert Smith-Johannsen, Portola Valley; Wendell William Moyer, Jr., Atherton, both of Calif.

[73] Assignee: Raychem Corporation, Menlo Park, Calif.

[22] Filed: Apr. 17, 1974

[21] Appl. No.: 461,528

[52] U.S. Cl. ..... 44/79

[51] Int. Cl.[2] ..... C10L 1/20

[58] Field of Search ..... 44/79; 260/649 F, 650 F

[56] References Cited

UNITED STATES PATENTS

| | | | |
|---|---|---|---|
| 2,023,871 | 12/1935 | Clarke et al. | 44/79 |
| 2,068,635 | 1/1937 | Prutton | 44/79 |
| 2,214,768 | 9/1940 | Lincoln | 44/79 |
| 2,967,894 | 1/1961 | Pummer | 260/650 F |
| 3,379,780 | 4/1968 | Robinson | 260/650 F |
| 3,388,174 | 6/1968 | Fielding et al. | 260/650 F |

FOREIGN PATENTS OR APPLICATIONS

| | | | |
|---|---|---|---|
| 679,623 | 9/1952 | United Kingdom | 44/79 |

*Primary Examiner*—Daniel E. Wyman
*Assistant Examiner*—Y. Harris-Smith
*Attorney, Agent, or Firm*—Lyon & Lyon

[57] ABSTRACT

Low boiling aryl fluoroalkane additives, such as benzotrifluoride, are utilized as a fuel additive for internal combustion engines. The additive volatilizes in the combustion chamber thereby giving a smoother running engine, prolonged spark plug life and a reduced octance requirement for high compression engines.

4 Claims, No Drawings

BENZOTRIFLUORIDE FUEL ADDITIVE FOR INTERNAL COMBUSTION ENGINES

BACKGROUND OF THE INVENTION

This invention relates to gasoline additives and more particularly to gasoline compositions containing small amounts of arylfluoroalkanes.

In recent years, because of the detrimental effect caused to both the environment and to the automobile engine itself by the use of highly leaded, high octane gasolines, a concerted effort has been made to reduce the octane requirements of the automobile engine. Because the addition of lead has, to date, been the most economical way of increasing the octane rating of a gasoline, its use has remained widespread throughout the industry where high octane gasolines are required. However, gasoline companies are marketing higher percentages of low leaded gasolines than ever before, such gasolines generally having a lower octane rating and being unsuitable for use in high compression engines.

On account of air pollution considerations, automobile manufacturers have turned almost exclusively to lower compression engines. With the rate at which high compression engines are presently decreasing, which is estimated at 7,000,000 cars a year, high performance, high compression automobiles may be substantially phased out by the end of the decade. This should result in a corresponding decrease in the sale of high octane gasolines, making it uneconomical for the major gasoline companies to even market such high octane products. Nevertheless, there are presently about 35 million high compression engine cars in the United States and its foreseeable that a substantial number of high compression, high performance automobiles will remain on the road as long as the proper fuel is available to run them. From the foregoing, it should become apparent that a fuel additive which will reduce the octane requirements of engines thereby allowing them to operate efficiently on low octane fuels may become highly desirable if high octane fuels are no longer available for purchase.

Although there are many additives in gasoline for many reasons, such as combustion moderators, lubricants, detergents, solvents, dehydrants, etc., such additives are usually not intended to substantially reduce the octane requirement of the engine and thereby permit the use of a much lower octane rated fuel than that recommended for the particular engine. Included in such additives are fluorinecontaining compounds. For example, in U.S. Pat. No. 2,186,916 to Gaylor, disclosed is an engine lubricant containing fluorinated mineral or vegetable oils which are stable below and boil above 200°C. These fluorinated compositions are employed in relatively large amounts, from about 5 to about 60% by weight of the lubricant composition. In U.S. Pat. No. 2,291,166 to Maag, fluorinated hydrocarbons, sufficiently stable as not to become detrimentally chemically active or decompose under operating conditions are utilized for the lubrication of internal combustion engines.

Some prior art patents have also proposed the use of fluorinated aromatic compounds as a fuel additive. However, fluorinated aromatic compounds, when recommended for use as a fuel additive, have generally been selected on account of their solvent or lubricating properties. In U.S. Pat. No. 2,214,768 to Lincoln, halogenated ring compounds are recommended for use in a fuel system for their lubricating properties, which includes carbon solvent action. In order to operate effectively as a lubricant, it is pointed out that the halogenated compounds selected should have a sufficiently low vapor pressure to remain as a liquid and not undergo combustion upon volatilization of the fuel in the combustion chamber. Likewise, in U.S. Pat. No. 2,281,598 to Prutton, which discloses fluorinated benzenes for use as a fuel additive to dissolve carbon deposits from the walls of an internal combustion engine, combustion of the solvent cannot be tolerated. For this reason it is recommended that in the selection of halogenated aromatic compounds, the halogen he attached to the benzene ring to insure stability. Finally, U.S. Pat. No. 2,838,387 to Rudel, broadly discloses aryl alkanes which are at least partially fluorinated for use as a fuel additive. However, since the object of adding such compounds to the fuel is again to dissolve carbon deposits, it is recommended that the compounds selected be substantially non-volatile, non flammable and thermally stable. To obtain these properties, the compounds of Rudel must have a boiling point of at least 100°C and preferably greater than 150°C, with at least 14 and preferably greater than 22 carbon atoms. The preferred compounds are high molecular weight polymers which will neither volatilize nor thermally decompose during the engine cycle.

In contrast, it is an object of this invention to provide a fuel additive which will readily volatize and pyrolize in the combustion chamber of a high compression engine.

It is another object of this invention to provide a fuel additive which will permit the use of lower octane gasolines for higher compression engines as well as prolong spark plug life and contribute to a cleaner engine.

It is yet another object of this invention to provide a fuel additive which may be added directly to the fuel tank by the consumer and which will chemically decompose during the engine cycle.

SUMMARY OF THE INVENTION

Low boiling aryl fluoroalkane additives for use as a fuel additive in internal combustion engines, wherein the additive volatilizes in the combustion chamber thereby leading to a cleaner operating engine and substantially decreasing the octane requirement of higher compression engines.

More particularly, benzotrifluoride and its derivatives, boiling below 195°C, is added to a fuel for use in an internal combustion engine which has the effect of prolonging spark plug life, smoothing out the operation and reducing the octane requirement for especially high compression engines.

DETAILED DESCRIPTION OF THE INVENTION

The additive compositions of this invention are benzotrifluoride compounds to be used with gasoline in minor proportions and which are volatilized with the fuel mixture in the combustion chambers of the engine. The compounds are pyrolyzed under engine operating conditions to yield what is believed to be fluoroalkyl radicals.

To avoid interference with fuel feed to the engine, care must be taken to ensure that the additives employed are compatible with the gasoline at the concentrations used. Preferably, from about 0.005% by weight to about 2% by weight benzotrifluoride base compounds, based upon the weight of gasoline, or mixtures of benzotrifluoride base compounds are employed. Other than the solubility and compatibility of the fluorocarbon additive with the gasoline, generally only economic considerations (i.e., the cost of the additive compounds) limits the amount of additive employed.

The benzotrifluoride compounds used should be volatizable with the fuel mixture fed to the combustion chamber and should be pyrolizable during combustion. However, highly volatile additive compounds should be avoided, inasmuch as such compounds are subject to volatile escape from stored fuel. Thus, the benzotrifluoride base compound employed in accordance with this invention should have a boiling point at atmospheric pressures from about 30°C to about 195°C and preferably from about between 95°C and 155°C.

The invention in its preferred embodiment, is further described and illustrated in the following examples:

EXAMPLE I 10 grams of benzotrifluoride is added to an automobile's 20 gallon tank filled with regular leaded gasoline (octane rating of about 94). The automobile has a high compression engine, i.e. greater than 9.0:1 compression ratio. This automobile, driven with this gasoline blend, exhibits satisfactory performance with no discernable "knock" as might be expected from the use of a low octane gasoline in a high compression engine.

EXAMPLE II

The same low lead gasoline, employed in Example I, but without the benzotrifluoride additive, is tested in the same high compression engine. Substantially poorer performance, with noticeable "knock" was evidenced upon the driving of the automobile.

EXAMPLE III

A 1967 Pontiac having a two barrel carburetor 400 cu. in. engine and a compression ratio of 10.5:1 was tested with benzotrifluoride additive at the level of 12 grams per 20 gallons. The mileage at the start of the test was 40,760.

The maximum road octane requirement was tested for both full throttle and part throttle through various speed ranges. The evaluations were conducted using a standard primary reference fuel. Table I shows that at the start of the test, prior to using the benzotrifluoride additive (0 accumulated mileage) the automobile required a fuel of 98.9 for proper performance. By using benzotrifluoride in the fuel for approximately 300 miles, the octane requirement of the engine dropped to 95.5, a significant decrease of greater than 3 full octane ratings.

Table 1

| Accumulated Mileage | Corrected Road Octane Requirement Primary Reference Fuel |
|---|---|
| 0 | 98.9 |
| 1,552 | 99.2 |
| 2,477 | 96.3 |
| 2,511 | 94.7 |
| 2,995 | 95.5 |

EXAMPLE IV

A 1965 Corvair, 8:1 compression ratio, with new spark plugs and with approximately 58,000 miles at the start of the test was operated for an 18 month period using about 10g. of benzotrifluoride per 12 gallons tank of gasoline. During this period the car was driven approximately 21,000 miles under widely varying driving conditions. Only "regular" fuel was used during the test perid. Prior to the test, the engine required a higher test gasoline than "regular" for proper performance. Use of straight "regular" fuel caused the engine to "ping" noticeably. When the benzotrifluoride was added to the "regular" gasoline during the test period, engine performance was improved and no "pinging" was observed. Occasionally the benzotrifluoride additive was left out of the fuel through oversight. When this happened, pinging would recommence after an "induction period" of about 200–300 miles. This "pinging" disappeared shortly after use of the additive was resumed. The engine operated smoothly and well during this test. The spark plugs were still good at the end of the test period.

EXAMPLE V

A "high-test" leaded gasoline, with an octane rating of about 98 is tested in the same high compression engine employed in Examples I and II. No discernable difference between engine performance is found between the "high-test" gasoline and the gasoline mixture of Example I.

From the tests conducted, it appears that the benzotrifluoride additive is suitable for increasing engine performance while decreasing the octane requirements of the gasoline. Also, the additive appears to aid the combustion process, clean up the cylinders and prolongs spark plug life. However, the chemical reaction of the benzotrifluoride additive is in marked contrast with fuel additives which improve engine performance via their solvent action, i.e. dissolution of carbon deposits and which are selected so as not to undergo any pyrolysis or decomposition reaction. When using solvent additives, they generally have little effect on the octane requirements of the engine. We have generally found that a gasoline having an octane rating of about four less than normally required by a particular engine may be utilized when benzotrifluoride is added to the gasoline.

It will be understood that other low boiling substituted benzotrifluoride base compounds may also be used in accordance with this invention. For example, p-chloro benzotrifluoride (B.P. 139.2°C), m-chloro benzotrifluoride (B.P. 138.1°C) o-chloro benzotrifluoride (B.P. 152.1°C), and m-xylene hexafluoride (B.P. 115.8°C) may be employed. Other structural isomers of xylene hexafluoride would also be expected to give satisfactory results. Actually, commercial grades of chloro benzotrifluoride or xylene hexafluoride usually contain mixtures of the various structrual isomers.

While this invention has been particularly shown and described with reference to the preferred embodiments and specific examples set forth therein, it will be understood by those skilled in the art that various changes in detail may be made without departing from the spirit and scope of the invention.

What is claimed is:

1. A fuel composition for use in an internal combustion engine which comprises in major proportions gasoline and in sufficient concentration to improve engine performance an aryl fluoroalkane wherein the aryl fluoroalkane is a substituted or unsubstituted benzotrifluoride.

2. The fuel composition of claim 1 wherein the benzotrifluoride base compound is in the range of about 0.005 to about 2 percent based on the weight of gasoline.

3. The fuel composition of claim 1 wherein the benzotrifluoride base compound is selected from the group consisting of benzotrifluoride, ortho, meta, para chlorobenzotrifluoride and ortho, meta, para xylene hexafluoride.

4. A fuel composition comprising gasoline and from about 0.005 to 2 percent of benzotrifluoride.

* * * * *